United States Patent [19]

Shiozaki et al.

[11] Patent Number: 4,953,994

[45] Date of Patent: Sep. 4, 1990

[54] THERMAL PRINTER WITH RECIPROCAL PAPER FEED CONTROL

[75] Inventors: Tsugio Shiozaki, Susono; Satoshi Kitahara, Mishima; Osamu Koizumi, Shizuoka; Ikuzo Sugiura, Sagamihara, all of Japan

[73] Assignee: Tokyo Electric Co., Ltd., Tokyo, Japan

[21] Appl. No.: 256,762

[22] Filed: Oct. 11, 1988

[30] Foreign Application Priority Data

Oct. 14, 1987 [JP] Japan ..... 62-157117
May 6, 1988 [JP] Japan ..... 63-59824

[51] Int. Cl.[5] ..... B41J 3/02

[52] U.S. Cl. ..... 400/120; 400/608.3; 400/708

[58] Field of Search ..... 400/120, 624, 55, 708, 400/711, 619, 636, 636.1, 636.2, 608.3; 346/76 PH

[56] References Cited

U.S. PATENT DOCUMENTS 4,169,682 10/1979 Norman ..... 400/120
4,562,444 12/1985 Nagashima et al. ..... 346/76 PH
4,650,351 3/1987 Engle et al. ..... 400/120
4,685,815 8/1987 Baranyi ..... 400/120
4,698,646 10/1987 Satoh et al. ..... 346/76 PH
4,705,414 11/1987 Guy et al. ..... 400/120
4,740,095 4/1988 Matsuura ..... 400/120
4,744,680 5/1988 Hirosaki et al. ..... 400/120
4,809,018 2/1989 Nakamura et al. ..... 400/120
4,834,563 5/1989 Ozawa et al. ..... 400/120

FOREIGN PATENT DOCUMENTS 61-266271 11/1986 Japan .

*Primary Examiner*—Eugene H. Eickholt
*Attorney, Agent, or Firm*—Frishauf, Holtz, Goodman & Woodward

[57] ABSTRACT

A thermal printer comprises a pair of fixed frames for rotatably supporting a platen which is rotated by a motor and a head unit rotatably supported by the fixed frames through a pair of movable frames and for supporting a thermal head. A pair of pinch rollers are rotatably mounted on the fixed frames, which are selectively brought to a first operating state to feed a paper sheet to the region between the platen and the thermal head, and a second operating state to feed no paper sheet. The thermal head is selectively moved between a first position, in which it is pressed against the platen, and a second position in which it is disengaged from the platen. The thermal head is moved to the first position, at the same time the pinch rollers and moved to the second operating state, while the thermal head is moved to the second position, at the same time the pinch rollers are moved to the first operating state.

9 Claims, 11 Drawing Sheets

THERMAL PRINTER WITH RECIPROCAL PAPER FEED CONTROL

BACKGROUND OF THE INVENTION

1. Field of the Invention

The present invention relates to a thermal printer adapted for printing characters and bar codes on paper sheets, such as labels.

2. Description of the Related Art

As an example of the conventional thermal transfer printer of this type, there is a label printer which is disclosed in Japanese Patent Disclosure No. 61-266271 (corresponding to U.S. Pat. No. 4,744,680, issured on May 17, 1988) by the same applicant.

In this label printer, characters and bar codes are printed on a label sheet by means of a line thermal printing head with a large printing width. In printing, the printing head is pressed against a platen with a ink ribbon and the label sheet between the head and the platen. This precedent invention is characterized in that a printer unit, in which a line thermal head and ink ribbon supply and take-up spindles are mounted on a pair of frames, is rockably or movably attached to a fixed mechanism section of a casing of the printer.

According to the prior art printer described above, it is very difficult to set the paper sheet in a predetermined printing region as performing a positioning operation, so that defective printing or waste of printing paper may be caused.

SUMMARY OF THE INVENTION

The object of the present invention is to provide a thermal printer in which a predetermined printing portion of a paper sheet can be accurately set in a printing region on a platen as performing a positioning operation, so that there is no possibility of defective printing or waste of printing paper.

According to the present invention, there is provided a thermal printer which comprises: a platen; platen supporting means for rotatably supporting the platen; platen drive means for rotating the platen; a thermal head; sheet transportation means which is selectively brought to a first operating state, in which the sheet transportation means is operatively connected with a paper sheet so that the paper sheet is fed to the region between the platen and the thermal head, and a second operating state in which the sheet transportation means is released from the operative connection with the paper sheet; head drive means for selectively moving the thermal head between a first position, in which the thermal head is pressed against the platen, and a second position in which the thermal head is disengaged from the platen; selecting means operatively connected to the sheet transportation means and the head drive means, which is selectively brought to a printable state, in which the thermal head and the sheet transportation means are in the first position and the second operating state, respectively, and a transportation state in which the thermal head and the sheet transportation means are in the second position and the first operating state, respectively; and detecting means for detecting the passage of the paper sheet and bringing the selecting means to the printable state.

Thus, in the thermal printer according to the present invention, the position of the thermal head relative to the platen and the operating state of the sheet transportation means, with respect to the paper sheet, are synchronously controlled in a predetermined relation, so that position of the paper sheet relative to the platen can be set with ease. Accordingly, defective printing and waste of printing paper can be avoided. If the present invention is applied to a thermal transfer printer using an ink ribbon, moreover, the ribbon can be saved.

BRIEF DESCRIPTION OF THE DRAWINGS

FIGS. 9 to 12 show a thermal transfer printer according to a second embodiment of the present invention, in which FIGS. 9 and 10 are sectional views schematically showing different operating states, FIG. 11 is a perspective view showing an arrangement of a timing gear of a sheet rewinding roller, and FIG. 12 is a flow chart for illustrating electrical control.

DETAILED DESCRIPTION OF THE PREFERRED EMBODIMENTS

Figure 1A:
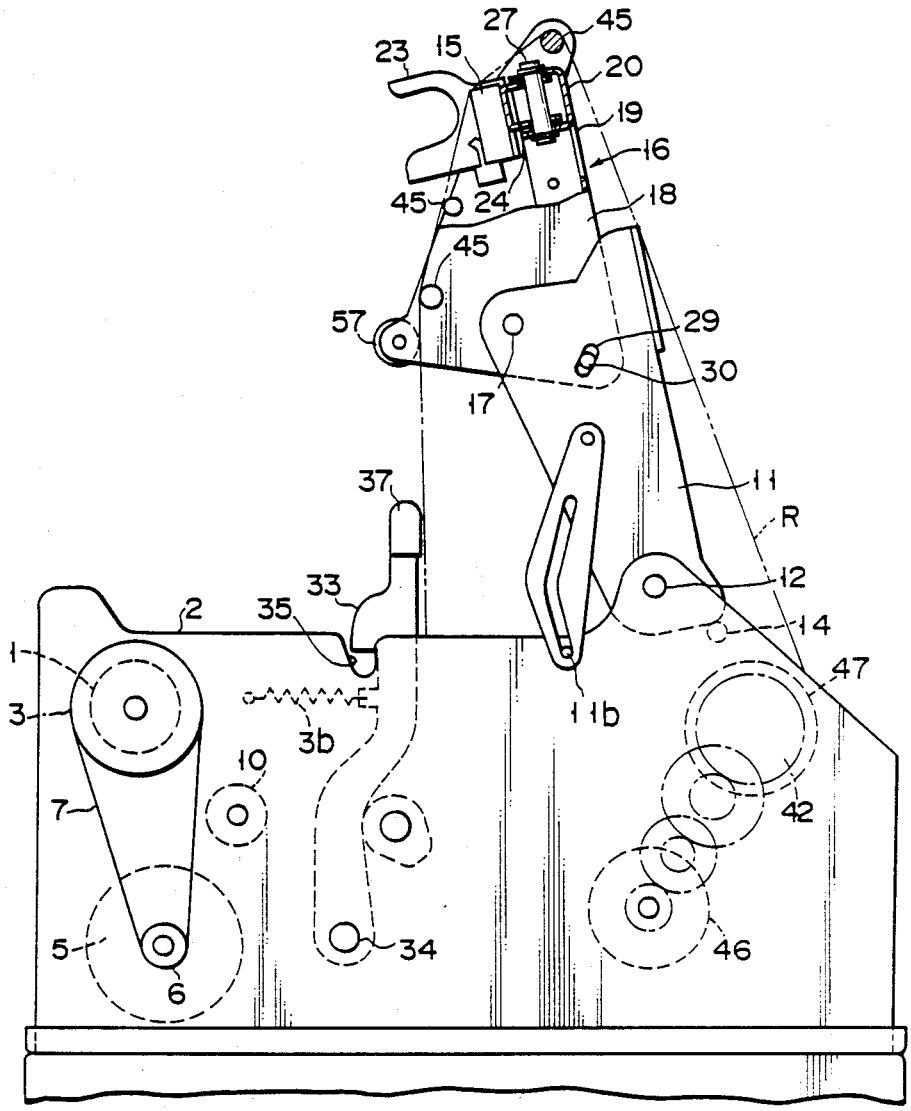
FIGS. 1A and 1B are right- and left-hand side views, respectively, of a thermal transfer printer according to an embodiment of the present invention.
Figure 1B:
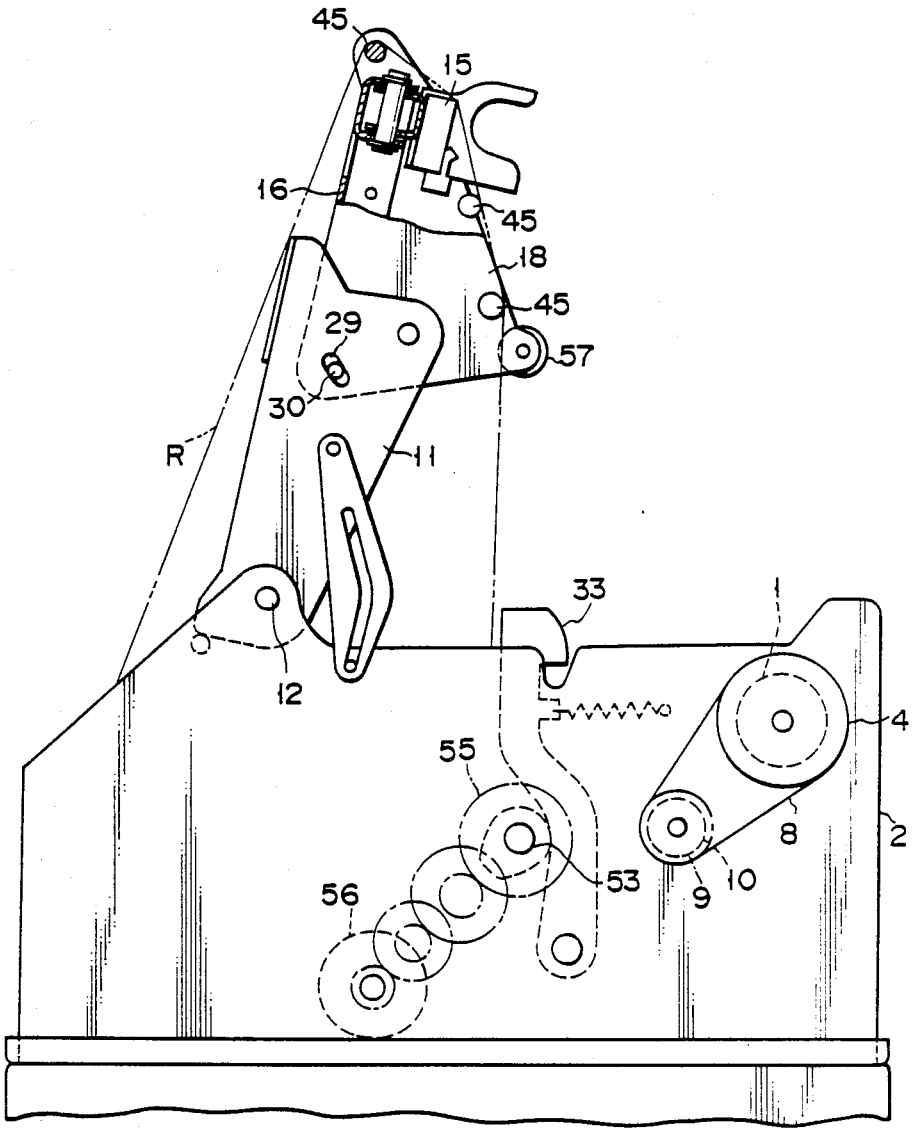

Referring now to the drawings of FIGS. 1 to 8, a thermal transfer printer according to an embodiment of the present invention will be described in detail.

In these drawings, numeral 1 designates a roller-shaped platen which is rotatably supported, at both ends thereof, on a pair of fixed frames (fixed supporting means for a platen) which are opposed to each other at a predetermined distance. Timing gears 3 and 4 are fixed individually to the respective projecting ends of slender platen shafts 21 at either end of platen 1. Timing belt 7 is passed around timing gear 3 (FIG. 1A) and motor gear 6 so that the driving force of platen drive motor 5 can be transmitted to gear 3 by means of motor gear 6 and belt 7. Motor 5 is mounted on the inside of one of fixed frames 2 with its rotating shaft projecting from the frame, for rotation in both forward and reverse directions. The other timing gear 4 is connected to timing belt 8 (FIG. 1B) so that the rotation of motor 5 can be transmitted to timing gear 9 through belt 8. Gear 9 is mounted on one end of sheet rewinding roller 10 which is rotatably supported, at both ends thereof, on fixed frames 2. Thus, roller 10 can be rotated in the same direction as platen 1.

Figure 2:
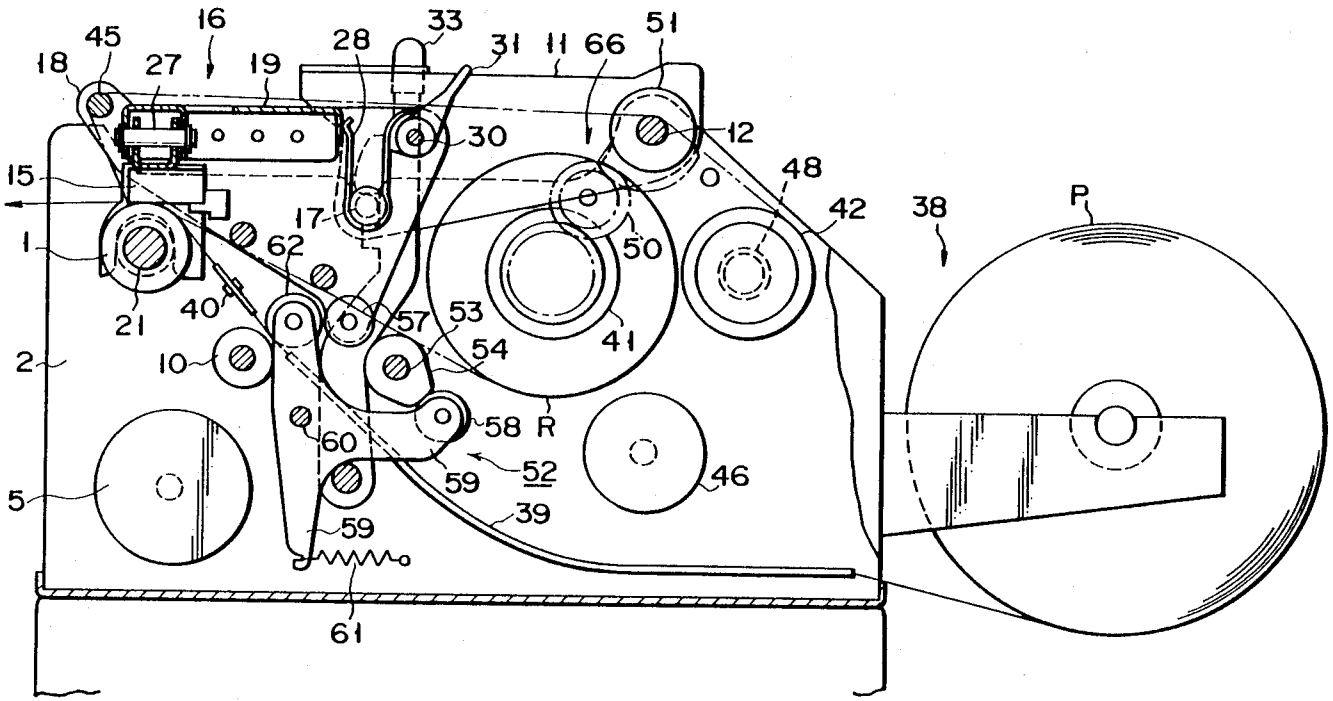
FIG. 2 is a vertical sectional view of the printer.

A pair of movable frames (movable supporting means for a thermal head) 11 are rockably mounted on the top portions of their corresponding fixed frames 2 by means of frame shaft 12 so that the top of platen 1 can be exposed. Shaft 12 is rockably supported, at both ends thereof, on fixed frames 2, and frames 11 are mounted on the opposite end portions of shaft 12 for associated rocking motion. Thus, movable frames 11 are rockable together with frame shaft 12 around the axis thereof, between an open position, where the top portion of the printer between fixed frames 2 is open, as shown in FIG. 1A, and a closed position where the top portion is closed, as shown in FIG. 2. Auxiliary frame 11*a* is pivotally mounted on each movable frame 11, and tension spring 13 is stretched between frame 11*a* and its corresponding fixed frame 2. A slit is bored through each auxiliary frame 11*a*, and guide pin 11*b* protrudes from each fixed frame 2. As pins 11*b* are loosely fitted in the respective slits of their corresponding auxiliary frames 11*a*, movable frames 11 are urged toward the open position by the action of springs 13. When movable frames 11 engage their corresponding stopper shafts 14 on the inside of fixed frames 2, they are retained in the open position.

Head unit 16 is rockably supported on the front end portions of movable frames 11 by means of support shaft 17. Elongated line thermal head 15, which is adapted to be pressed against platen 1, is swingably held on unit 16 with the aid of the means mentioned later. The head unit includes a pair of head arms 18 facing each other and head base 19 fixed to the inside of arms 18. Arms 18 are rockably supported on movable frames 11 by means of support shaft 17.

Head holding portion 20, having a U-shaped cross section and open at the bottom, is formed at the central portion of the front end of head base 19. Holding portion 20 extends along the longitudinal axis of head base 19 (parallel to support shaft 17).

Line thermal head 15 has an elongated configuration extending along the longitudinal axis, and head bracket 23 is fixed to the back of the head. Bracket 23 has engaging recesses 22 individually at its opposite ends, which are adapted to releasably engage platen shaft 21 of platen 1. The engaging portions protrude forward from thermal head 15. U-shaped head coupling portion 24, which is open at the top, is provided on the central portion of bracket 23. Coupling shaft 27, which extends at right angles to the longitudinal axis, is passed through holes 25 and 26 in the center of coupling portion 24 and head holding portion 20, respectively. Thus, line thermal head 15 is mounted on holding portion 20 so as to be swingable around shaft 27 and thus its counter. In other words, head 15 is mounted on head base 19 so that it is swingable around an axis parallel to its front face and perpendicular to the direction of its length. The respective central portions of a pair of leaf springs 28 having a U-shape are coiled around support shaft 17 (FIGS. 2 and 5A to 5C). One end of each spring 28 is held against the rear end of head base 19, thereby urging head unit 16 to rock around shaft 17 toward the platen. Each movable frame 11 has arcuate slot 29 whose center of curvature lies on the axis of support shaft 17. Cam shaft 30 is rockably attached to head unit 16. As both end portions of shaft 30 are fitted in their corresponding slots 29, the rocking motion of head unit 16, i.e., line thermal head 15, relative to movable frames 11, is restricted within a predetermined range.

Figure 4A:
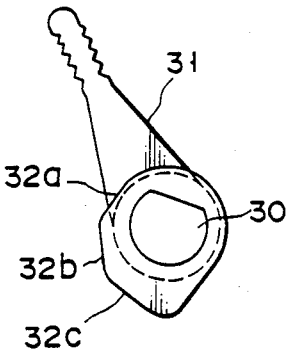
FIGS. 4A and 4B are a side view and a perspective view, respectively, of a head adjusting cam of the printer.
Figure 4B:
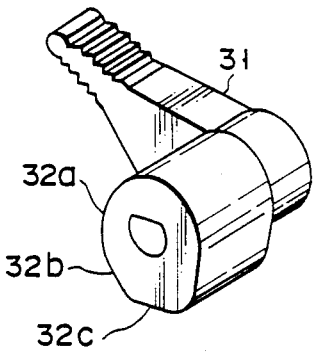
Figure 5A:
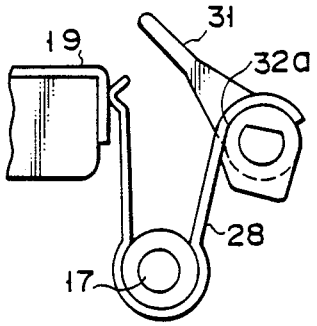
FIGS. 5A, 5B and 5C are side views individually showing different operating states of the adjusting cam.
Figure 5B:
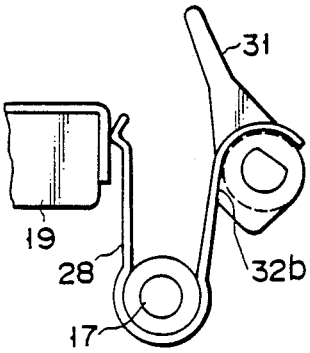
Figure 5C:
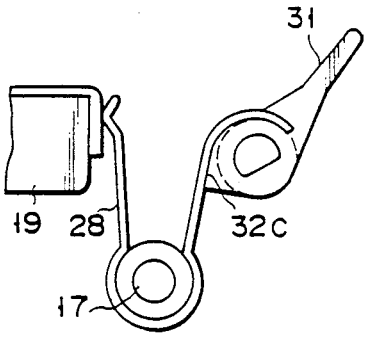
Figure 6:
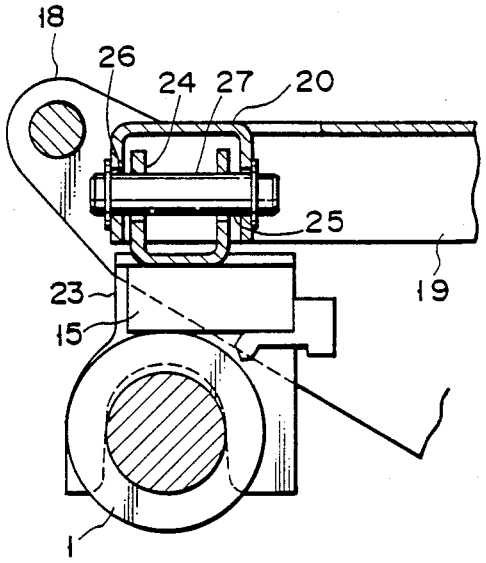
FIG. 6 is a sectional view showing a support structure for a thermal printing head of the printer.

A pair of head adjusting cams 31 are mounted on cam shaft 30. They serve to adjust the urging force of leaf springs 28 by stages. As shown in FIGS. 4A and 4B, a plurality of flat cam faces 32*a*, 32*b* and 32*c* are formed along the outer periphery of cam 31 so that they are situated at different distances from cam shaft 30. A flat face of each leaf spring 28 at the other end portion thereof is urged to be in plane contact with any of flat cam faces 32*a* to 32*c*. In this embodiment, each head adjusting cam has three cam faces. First cam face 32*a* is nearer to shaft 30 than the other two are, and third cam face 32*c* is the remotest. Thus, if spring 28 engages first cam face 32*a*, as shown in FIG. 5A, it applies the smallest urging force to line thermal head 15 to be pressed against the surface of platen. If spring 28 engages second and third cam face 32*b*, 32*c*, as shown in FIGS. 5B, 5C, it applies a greater and the greatest urging forces to head 15, respectively. Since these cam faces are flat surfaces, they serve to lock cam 31 in position as they are engaged by spring 28, unless a lever of the cam is rocked. The selection of the cam face to be engaged depends on the thickness and quality of the paper sheet used. If the sheet is relatively thick or firm, cam 31 is set in the position shown in FIG. 5C to produce the greatest urging force. If the sheet is thin or weak, on the other hand, the cam is set in the position shown in FIG. 5A to reduce the urging force. The urging force of spring 28 to press thermal head 15 toward platen 1 is changed when the position of head bracket 23 relative to platen shaft 21 is slightly shifted.

Paired head adjusting cams 31, which are fixed to cam shaft 30, are adapted to rock together therewith. Therefore, they need not always be two in number, and it is necessary only that at least one adjusting cam be provided for the purpose. Cams 31 are located exposed beside movable frames 11 in order that they can be manually operated from the outside. The respective lower ends of a pair of lock levers 33 are pivotally mounted on the inner surfaces of their corresponding fixed frames 2 by means of shaft 34. Both end portions of shaft 34 are rockably supported on their corresponding fixed frames 2. Thus, lock levers 33 are mounted on frames 2 so as to be rockable around the axis (indicated by line B—B in FIG. 3) of shaft 34. When movable frames 11 are brought to the closed position, levers 33 engage the top of support shaft 17 so that shaft 17 is fitted and retained in recesses 35 formed in the respective top edges of fixed frames 2, thereby preventing movable frames 11 from rocking. Each lever 33 is urged in the counterclockwise direction of FIG. 1A by means of tension spring 36. Knob 37 is attached to one of lock levers 33. If knob 37 is operated to rock levers 33 in the clockwise direction of FIG. 1A, against the urging force of springs 36, movable frames 11 are released from the locked state. In rocking frames 11 to the closed position, support shaft 17 is held against the lateral faces of lock levers 33, and levers 33 are rocked against the urging force of springs 36. When movable frames 11 are rocked in this manner, they are locked automatically.

Sheet holding member 38 for holding wide label sheet P protrudes from the rear end portions of fixed frames 2. It is composed of a pair of support arms spaced in the longitudinal direction of the printer. A bearing or recess is formed on the top surface of each support arm. Rolled label sheet P is wound around a support shaft, both end portions of which project individually from the opposite sides of sheet P. As the projecting end portions of the shaft are rotatably supported by the bearings of the support shafts, sheet P is held by holding portion 38 so as to be rotatable around the axis of the support shaft. The leading end of sheet P is drawn out from its outermost periphery. Thus, sheet P is guided to a printing section through sheet guide passage 39, which is composed of a pair of curved plates vertically spaced at a very short distance from each other and arranged below movable frames 11. Paper sensor 40 is attached to that portion of passage 39 situated between platen 1 and sheet rewinding roller 10. Sensor 40 serves to optically detect the presence of label sheet P, that is, the leading end of the sheet.

Ink ribbon supply roll 41 and ink ribbon take-up roll 42 are rotatably mounted on the inside of fixed frames 2. Supply roll 41 serves to feed wide ink ribbon R to the printing section, while take-up roll 42 is used to wind the used portion of the ink ribbon. Rolls 41 and 42 are removably held by their corresponding pairs of roll holders 43 and 44, which are mounted individually on the inside of frames 2. Ink ribbon R on supply roll 41 is wound around take-up roll 42 after being passed around a plurality of ribbon guide shafts 45 (three in this embodiment), which are fixed to head arms 18 and extend parallel to the longitudinal axis of the printer. One of paired roll holders 43 is pressed against one end face of roll 41 by means of a coil spring disposed between itself and its corresponding fixed frame 2. Likewise, one of roll holders 44 is pressed against one end face of roll 42 by means of another coil spring disposed in the same manner. Thus, rolls 41 and 42 can be easily mounted on or removed from their corresponding holders 43 and 44. The other of holders 44 for take-up roll 42 is coaxially connected to take-up gear 47 by means of one-way clutch 48. As shown in FIG. 1A, take-up gear 47 is operatively connected, by means of a gear train, to take-up motor 46 which is fixed to the inside of one of fixed frames 2. Thus, as the driving force of motor 46 is transmitted to ink ribbon take-up roll 42 via take-gear 47 and one-way clutch 48, roll 42 is rotated in a take-up direction or the clockwise direction of FIG. 2. Feed gear 49, which contains one-way clutch **49*a* therein, is coaxially attached to the other of roll holders 43 which hold ink ribbon supply roll 41. Gear 49 is in mesh with a largediameter portion of intermediate gear 50, a double gear. A small-diameter portion of gear 50 is in mesh with ribbon rewinding gear 51 which is coaxially fixed to frame shaft 12 between movable frames 11. Gear 51 is composed of a sector gear whose center is on the axis of shaft 12. Thus, when movable frames 11 are rocked to the closed position, rewinding gear 51 also rocks, thereby causing intermediate gear 50 to rotate through an angle corresponding to the rocking motion of frames 11. The rotation of gear 50 is transmitted through feed gear 49 to the other roller holder 43. Thereupon, supply roll 41 is rotated through a predetermined angle in the clockwise direction of FIG. 2**, i.e., in the direction opposite to a ribbon feeding direction.

Figure 3:
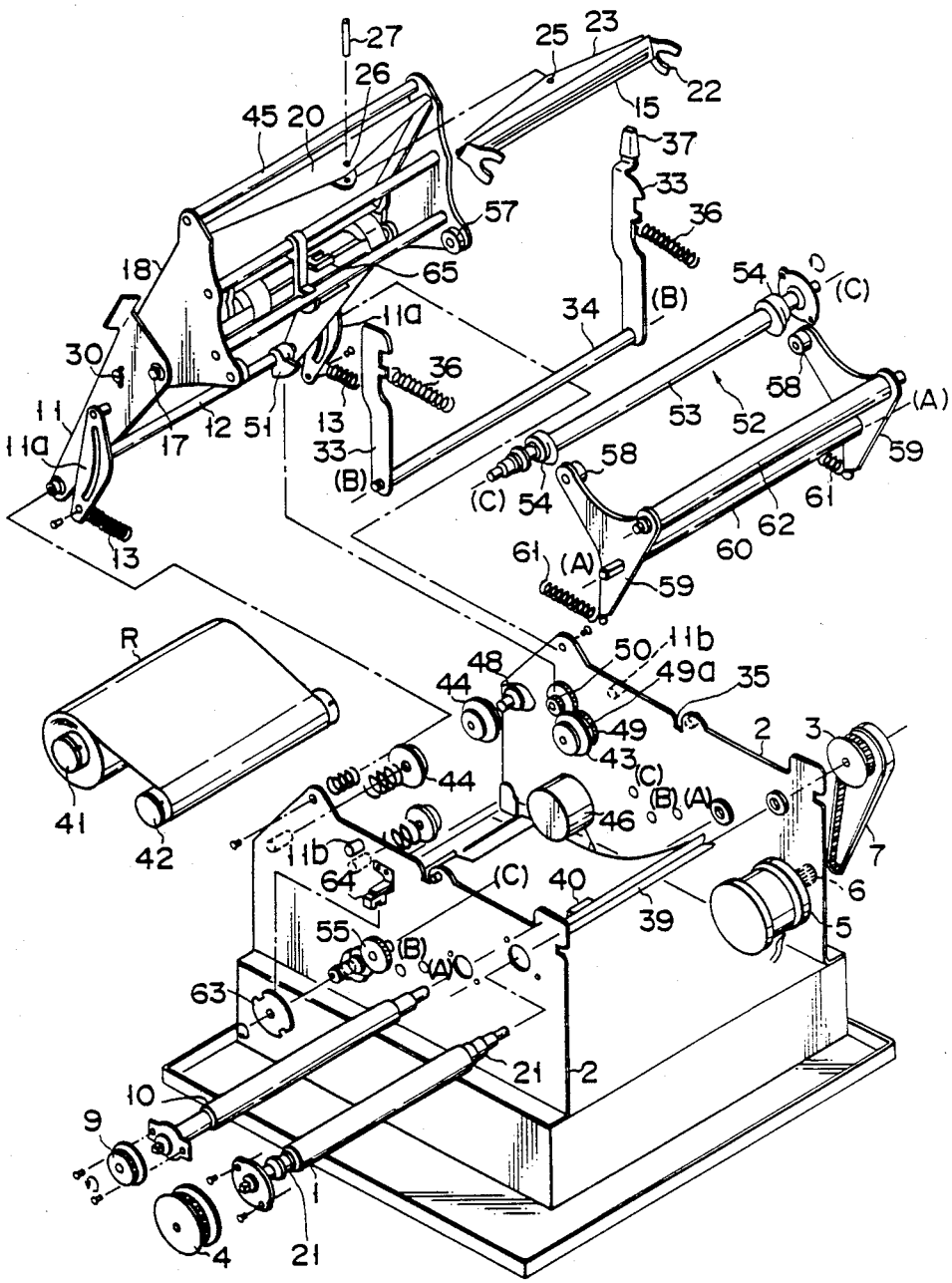
FIG. 3 is an exploded perspective view of the printer.
Figure 7:
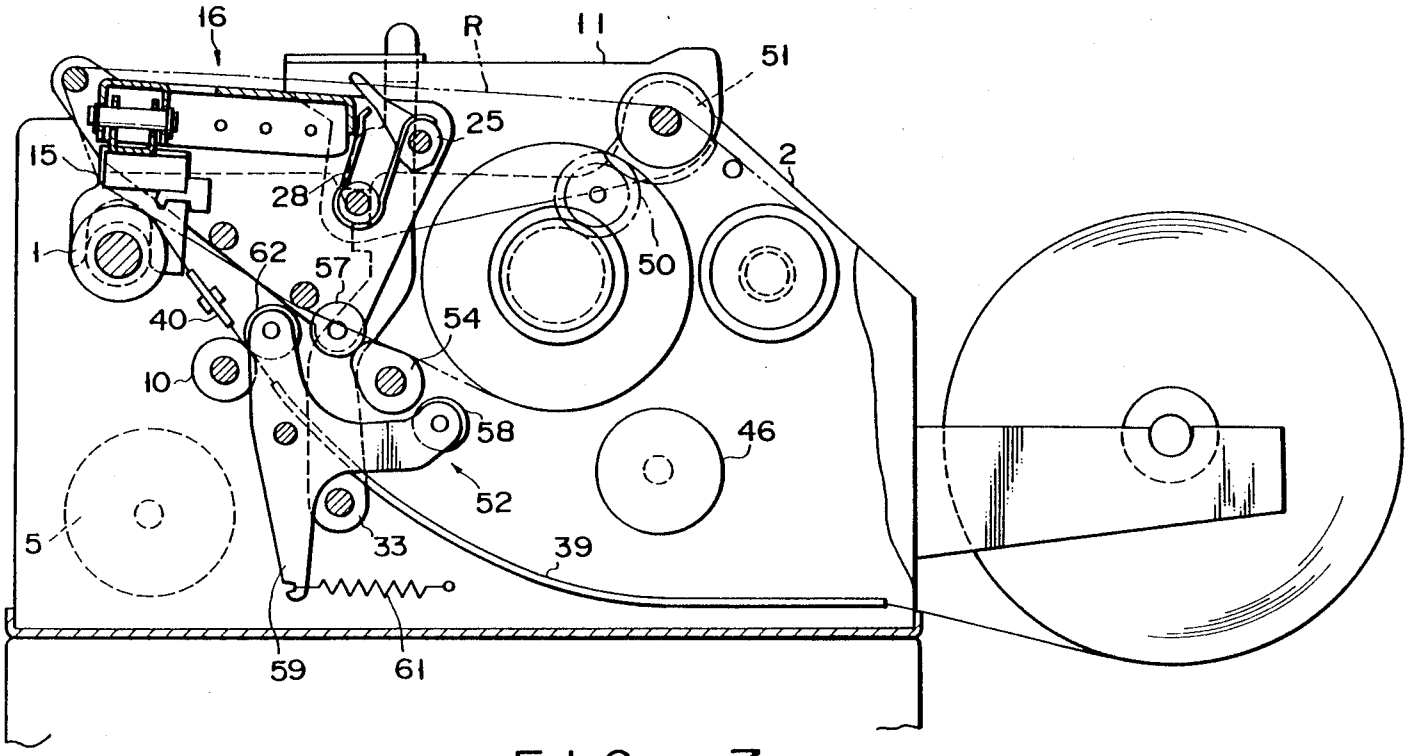
FIG. 7 is a sectional view, similar to FIG. 2, illustrating the operation of a head-up mechanism of the printer.

Head-up mechanism 52 is located beside sheet rewinding roller 10. It serves to temporarily force up line thermal head 15, in pressure contact with platen 1, when movable frames 11 are in the closed position. As shown in FIG. 3, mechanism 52 includes cam shaft 53 and a pair of cams 54 fixed individually to the opposite end portions of shaft 53. Shaft 53, which extends in the longitudinal direction (line C—C) of the printer, is rotatably supported, at both ends thereof, to fixed frames 2. Gear 55 (FIG. 1B) is coaxially mounted on one end of cam shaft 53. It is connected, by means of a gear train, to cam drive motor 56 which attached to the other fixed frame 2. Thus, cam 54 is rotated by means of motor 56. A pair of head-up rollers 57 are rotatably mounted on head arms 18, individually, so that they are situated in the paths of rotation of their corresponding cams 54 when movable frames 11 are in the closed position. A pair of sheet rewinding arms 59 are arranged inside those portions of fixed frames 2 near sheet rewinding roller 10. Each end portion of shaft 60, which extends parallel to roller 10, is fixed to the central portion of each corresponding arm 59. Both ends of shaft 60 are movably supported on fixed frames 2, individually. As shaft 60 rocks, arms 59 can rock together therewith around the longitudinal axis (line A—A) of shaft 60. Pinch roller 62, which extends parallel to rewinding roller 10, is rotatably supported, at both ends thereof, on sheet rewinding arms 59. Tension spring 61 is disposed between each arm 59 and its corresponding fixed frame 2. As shown in FIG. 7, spring 61 urges arm 59 to rock in the counterclockwise direction, thereby pressing pinch roller 62 against sheet rewinding roller 10. Release rollers 54, which can engage cams 54, are rotatably mounted on sheet rewinding arms 59, individually. When cams 54 engage their corresponding rollers 58, arms 59 are rocked against the urging force of springs 61, so that pinch roller 62 is disengaged from rewinding roller 10. In FIG. 3, numeral 63 designates a cam detecting plate attached to one end of cam shaft 53. Numeral 64 designates a cam sensor for optically detecting the rotational position of cams 54 through detecting plate 63, while numeral 65 denotes a ribbon sensor for optically detecting the presence of ink ribbon R.

In printing on wide label sheet P, in the printer with the arrangement described above, ink ribbon supply roll 41 and ink ribbon take-up roll 42 are first set inside fixed frames 2. The leading end of ink ribbon R, wound around supply roll 41, is passed around ribbon guide shafts 45 between head arms 18, and is then anchored to take-up roll 42. Meanwhile, the leading end portion of label sheet P, held by sheet holding portion 38, is drawn out and passed through sheet guide passage 39 to be set on platen 1. Then, in this state, movable frames 11 are brought down to the closed position, where they are fixed to fixed frames 2, and line thermal head 15 is pressed against platen 1. As movable frames 11 rock in this manner, ribbon rewinding gear 51 also rock, thereby causing ribbon supply roll 41 to rotate in the counterclockwise direction of FIG. 2, through the medium of intermediate gear 50 and feed gear 49. Thereupon, ink ribbon R, which is drawn out long to cover ribbon take-up roll 42 via supply roll 41 and thermal head 15, is rewound. Accordingly, a tension toward supply roll 41 is applied to ribbon R, so that the ribbon can be prevented from slackening or be smoothed out. Ribbon rewinding gear 51 rocks also when movable frames 11 are raised from fixed frames 2. In this case, however, ribbon supply roll 41 never rotates, since one-way clutch **49*a* is contained in feed gear 49**.

When line thermal head 15 is pressed against platen 1, moreover, cam drive motor 56 is caused to rotate for a predetermined amount by means of a detection switch (not shown). Thereupon, cams 54, having so far been in engagement with release rollers 58, are caused to engage head-up rollers 57. Thus, pinch roller 62 is pressed against sheet rewinding roller 10, and thermal head 15 is forced up through the medium of head arms 18, as shown in FIG. 7.

When line thermal head 15 is lifted from platen 1, platen drive motor 5 rotates reversely. Thus, label sheet P, held between pinch roller 62 and sheet rewinding roller 10, is retreated from platen 1 as roller 10 rotates. When paper sensor 40 detects passage of the leading end of sheet P, the rotation of motor 5 is stopped in response to an output signal from the sensor. Thereupon, the leading end of the sheet is set in a predetermined position behind sensor 40, whereupon its alignment is completed. In this state, platen drive motor 5 rotates forward, and cam drive motor 56 rotates again for a predetermined amount in response to the output signal from sensor 40, after the passage of a predetermined time (or when sheet P is brought onto platen 1). As a result, cams 54, having so far been in engagement with head-up rollers 57, are caused to engage release rollers 58. Thus, thermal head 15 is pressed again against platen 1 with the leading end portion of sheet P between the two, and pinch roller 62 is separated from sheet rewinding roller 10, as shown in FIG. 2. Thereafter, thermal head 15 is heated to accomplish a specific cycle of printing operation, and platen 1 is rotated to feed label sheet P forward.

Figure 8:
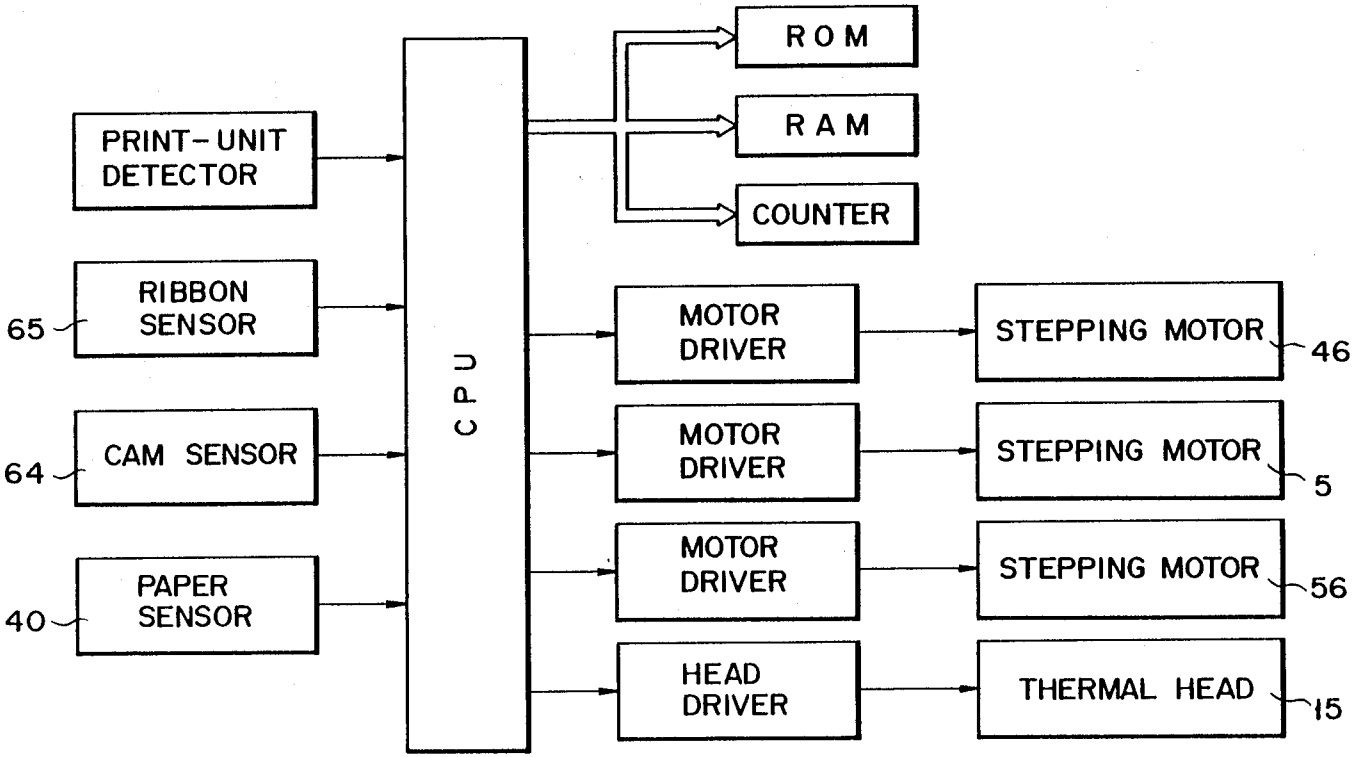
FIG. 8 is a block diagram of an electrical control system of the printer.

FIG. 8 shows an electrical control system of the thermal transfer printer with the aforementioned construction. As seen from FIG. 8, a CPU is used as a principal control means for the printing operation. In this system, a ROM and a RAM are designed for label layout, just as in the case of the prior art printers.

Referring now to FIGS. 9 to 12, a thermal transfer printer according to a second embodiment will be described. In the description of this embodiment to follow, like reference numerals are used to designate substantially the same or similar members as are used in the foregoing embodiment.

Two timing gears 3 and 4, which are mounted on platen 1 rotatably supported on fixed frames 2, are both arranged on one end side of the platen. Tension roll 100 is mounted on the fixed frame, in rolling contact with belt 8 which is stretched between gear 4 and timing gear 9 of sheet rewinding roller 10.

Figure 11:
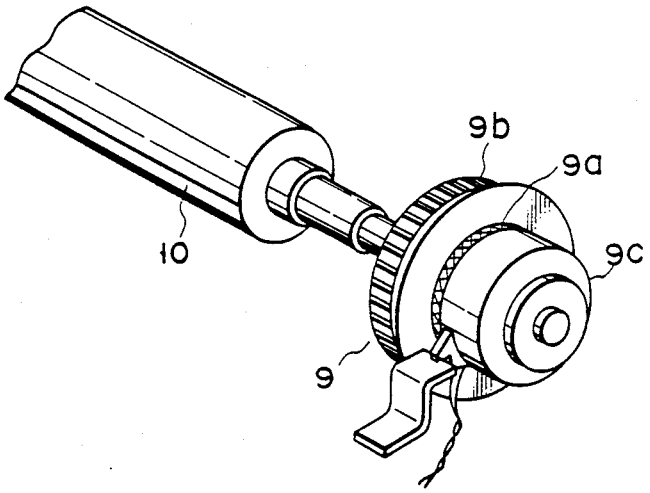

Timing gear 9 is provided with a one-way clutch. As shown in FIG. 11, gear 9 is composed of largediameter toothed pulley **9*b*, fitted with permanent magnet 9*a* on its lateral face, and electromagnetic clutch 9*c* having a solenoid therein. When clutch 9*c* is off, sheet rewinding roller 10 is disconnected from belt 8, so that the rotatory force of belt 8 cannot be transmitted to roller 10. When clutch 9*c* is on, an attractive portion of the solenoid is attracted to magnet 9*a*, and belt 8 and pulley 9*b* are connected to each other, so that the rotatory force of belt 8 is transmitted to roller 10**.

Figure 12:
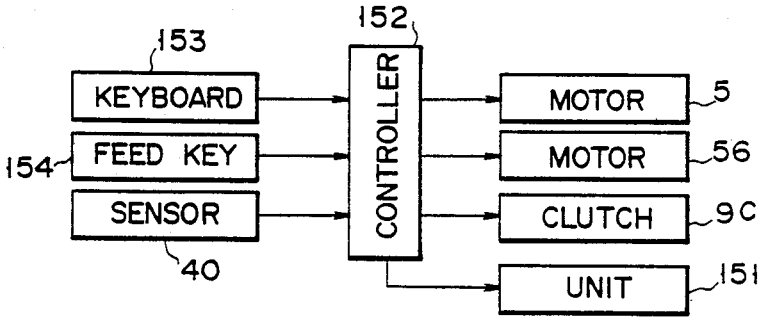

Sheet cutting unit 151, having cutter 150 therein, is removably attached to the sheet outlet side of fixed frames 2 or on the downstream side of the platen. In response to a command from control unit 152 (composed of a host computer or the like) connected to the printer body (fixed frames 2), cutting unit 151 is controlled so that cutter 150, which is spaced from platen 1, cuts that portion of label sheet P which is printed and fed. During this cutting operation, control unit 152 controls various devices, thereby returning sheet P to the printing region in order that printing can be started again from its leading end. FIG. 12 shows a control circuit for this purpose.

The following is a description of the control circuit.

In FIG. 12, numeral 153 designates a keyboard which is used to feed necessary information for printing to control unit 152. Unit 152 is connected with platen drive motor 5, head-up motor 56, electromagnetic clutch 9, and sheet cutting unit 151. When a command for cutting the printed portion of label sheet P is inputted by means of keyboard 153, the printed portion of the sheet is cut, platen drive motor 5 is reversed, and clutch **9*c* is turned on. Then, head-up motor 56 is rotated for an enough amount to force up head-up roller 57. Thereupon, thermal head 15 and ink ribbon R are disengaged from platen 1, and sheet P is fed in its returning direction by sheet rewinding roller 10 and pinch roll 62 which hold the sheet therebetween. Thus, the leading end of sheet P can be located in the printing region by returning the sheet for a distance corresponding to a projection of a predetermined length (distance between platen 1 and cutter 150) indicated by l in FIG. 9. Under the control of control unit 56, moreover, clutch 9*c* is turned off, and head-up motor 56 is rotated for an enough amount to restore head-up roller 57 to its original position, after the sheet is returned as aforesaid. As platen drive motor 5** rotates forward thereafter, print issuance can be started with the leading end portion of sheet P forward.

Besides, control unit 152 controls the printer as follows. When sheet feed key 154 on the printer-body side is operated, platen drive motor 5 rotates forward, and electromagnetic clutch **9*c* is turned on. Further, head-up motor 56 is rotated for a predetermined amount to the force-up side, whereby the leading end portion of label sheet P, inserted between sheet rewinding roller 10 and pinch roller 62, is located on platen 1. Thereafter, upped thermal head 15 is restored to its original position. The presence of the leading end portion of sheet P on platen 1 is determined in accordance with the result of detection by paper sensor 40 in sheet path 39. Subsequently, if necessary information for print issuance is inputted through keyboard 153, electromagnetic clutch 9*c* is turned off, and platen drive motor 5 rotates forward in accordance with instructions from control unit 152**. Thus, printing on label sheet P is started.

The following is a description of the operation of the thermal transfer printer with the aforementioned construction.

In starting printing operation, the leading end portion of label sheet P is first inserted into sheet path 39 from the inlet side thereof until it is prevented from being further pushed in, that is, until it reaches the rolling contact region between sheet rewinding roller 10 and pinch roller 62. Thereafter, the roll of sheet P is set on roll holder 38 attached to fixed frames 2.

Figure 9:
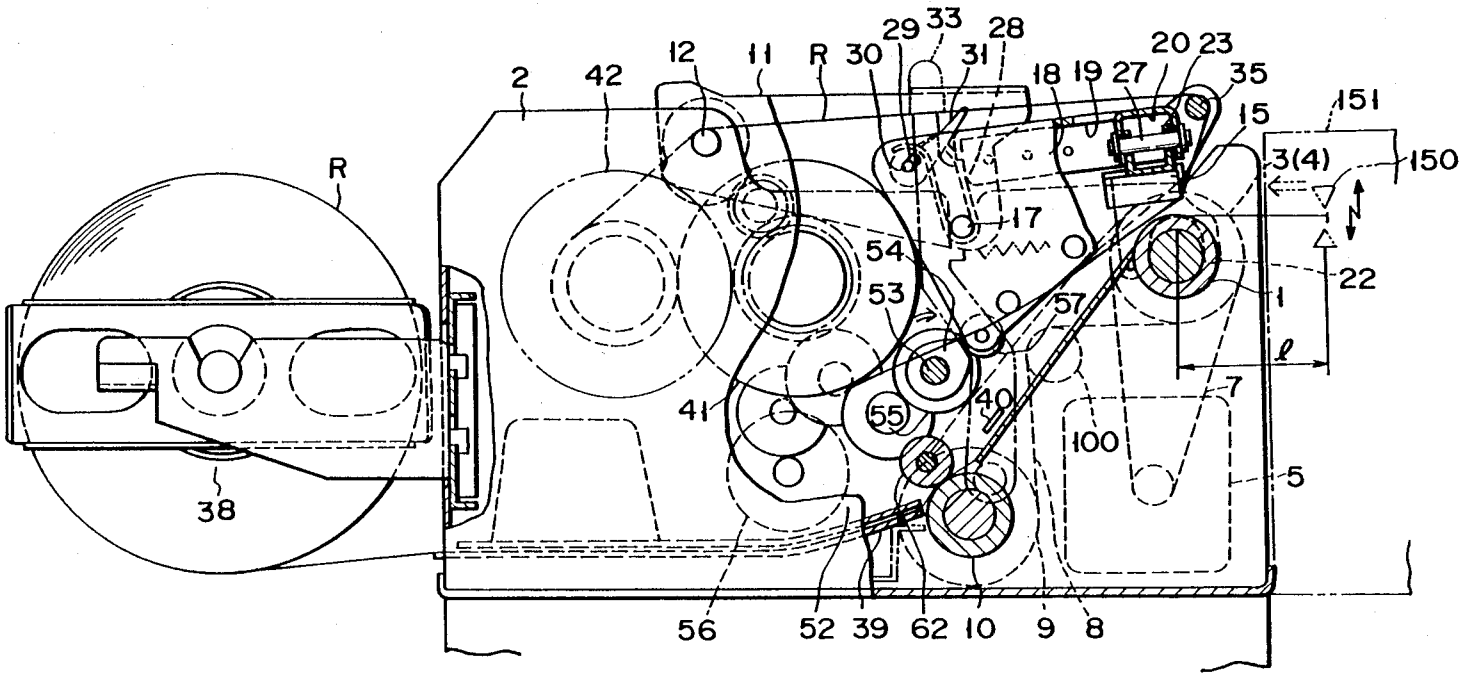
Figure 10:
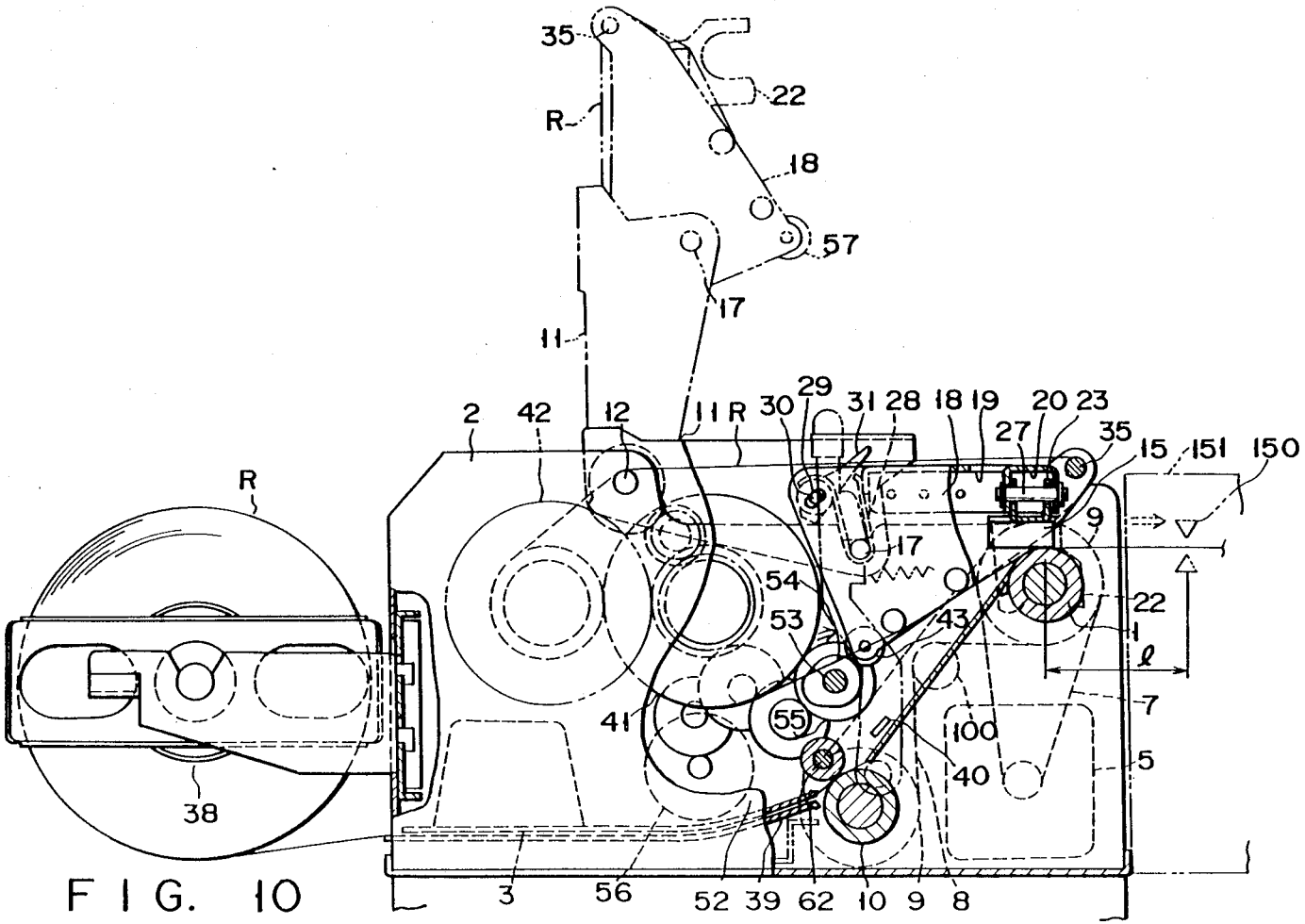

Then, sheet feed key 154 is operated. Thereupon, head-up motor 56 rotates, so that head-up cams 54 rock upward to force up head-up rollers 57. Thus, head arms 18 rock upward around support shaft 17. As a result, thermal head 15, along with ink ribbon R, is disengaged from platen 1, as shown in FIG. 9. As motor 56 is actuated, platen drive motor 5 rotates forward, and electromagnetic clutch **9*c* is turned on. Accordingly, the leading end portion of label sheet P, held between sheet rewinding roller 10, rotating forward, and driven pinch roller 62, is fed thereby for a predetermined distance onto platen 1. Subsequently, when the delivery of sheet P toward platen 1 is detected by paper sensor 40, clutch 9*c* is turned off, and head-up motor 56 rotates again, thereby lowering head-up cams 54. Thereupon, head-up arms 18 rock downward, so that thermal head 15, along with ink ribbon R, is pressed toward sheet P on platen 1** to be ready for printing.

If necessary information for printing and cutting is inputted through keyboard 153, thereafter, set bar codes, characters, and/or symbols are printed on the surface of label sheet P. Thus, after the input operation, platen drive motor 5 rotates forward, with electromagnetic clutch **9*c* kept off, so that platen 1 rotates forward. Accordingly, the set printing information is transferred to the surface of advancing sheet P by thermal head 15, with the aid of ink ribbon R. As the printing operation advances in this manner, the printed portion of sheet P is delivered to sheet cutting unit 151. After the printing is finished, that portion of label sheet P to be cut is guided to a cutter position (indicated by two-dot chain line in FIG. 10) as the sheet is fed forward. Thereafter, cutter 150** is actuated to cut sheet P for a predetermined length.

After the end of the cutting operation, head-up motor 56 rotates, so that head-up cams 54 rock upward to force up head-up rollers 57, as shown in FIG. 9. Thus, head-up arms 18 rock upward around support shaft 17. As a result, thermal head 15, along with ink ribbon R, is disengaged from platen 1, as in the case of setting label sheet P. As motor 56 is actuated, platen drive motor 5 rotates reversely, and electromagnetic clutch 9c is turned on. Accordingly, only sheet P, held between sheet rewinding roller 10, rotating reversely, and driven pinch roller 62, is returned thereby for a predetermined distance. More specifically, the extreme end portion of projection l (FIG. 9), extending from platen 1 to the cutting position for the cutting operation, is returned to a predetermined position on the platen.

When the leading end portion of label sheet P is returned to the printing region, electromagnetic clutch 9c is turned off, and head-up motor 56 rotates again, thereby lowering head-up cams 54. Thereupon, head-up arms 18 rock downward, so that thermal head 15, along with ink ribbon R, is pressed against sheet P on platen 1. Thus, printing can be started again from the leading end portion of sheet P.

Despite the cutting operation, therefore, label sheet P can be used for printing without a loss. In returning sheet P, moreover, thermal head 15 is disengaged together with ink ribbon R from platen 1. Therefore, ribbon R can never return or soil the sheet surface. While the sheet is being transported, the thermal head and, hence, the ink ribbon are separated from the platen. Accordingly, the ribbon cannot be fed excessively, that is, there is no waste of the ribbon.

In the embodiments described above, the thermal transfer printer uses the ink ribbon for printing. However, the ink ribbon need not always be used, and the printer may be of a type such that the thermal head can print directly on a heat-sensitive paper sheet.

What is claimed is:

1. A thermal printer comprising:

a platen (1);

platen supporting means (2) for rotatably supporting the platen;

platen drive means (3, 5, 7) for rotating the platen;

a thermal head (15) for printing on a paper sheet, the paper sheet being arranged in a region between the platen and the thermal head;

head drive means (11, 16) for selectively moving the thermal head between a first position in which the terminal head is pressed against the platen, and a second position in which the thermal head is disengaged from the platen;

sheet transportation means (9, 10, 62) for selectively feeding a paper sheet in a first direction, such that the paper sheet is fed to the region between the platen and the thermal head, and in a second direction such that the paper sheet is returned from the region between the platen and the thermal head, when the thermal head is in the second position; and detecting means (40) for detecting the passing of the paper sheet moving in the second direction between the platen and the sheet transportation means and for driving the sheet transportation means to transport the paper sheet in the first direction.

2. The thermal printer according to claim 1, wherein said sheet transportation means is selectively brought to a first operating state in which the sheet transportation means is operatively connected with the paper sheet so that the paper sheet is fed, and a second operating state in which the sheet transportation means is released from the operative connection with the paper sheet, and which further comprises selecting means (54, 57, 59) operatively connected to the sheet transportation means and the head drive means, which is selectively brought to a printable state in which the thermal head and the sheet transportation means are in the first position and to the second operating state, respectively, and a transportation state in which the thermal head and the sheet transportation means are in the second position and the first operating state, respectively.

3. The thermal printer according to claim 2, wherein said head drive means includes a first movable member (11) rockably mounted on the platen supporting means and a second movable member (16) rockably mounted on the first movable member and supporting the thermal head, said first movable member being rockable relative to the platen supporting means between an operative position, in which the thermal head is situated close to the platen, and a nonoperative position in which the thermal head is remote from the platen, said second movable member being rockable relative to the first movable member, between the first and second positions, when the first movable member is in the operative position.

4. The thermal printer according to claim 1, further comprising supporting means for rotatably supporting a rolled paper sheet, a part of which constitutes the paper sheet.

5. A thermal printer, comprising:

a platen (1);

a thermal head (15) for printing on a paper sheet, the paper sheet being arranged in a region between the platen and the thermal head;

platen supporting means (2) for rotatably supporting the platen;

platen driving means (3, 5, 7) for rotating the platen, to transport the paper sheet during a printing operation;

sheet transportation means (9, 10, 62) which is selectively brought to a first operating state, in which it is operatively connected with the paper sheet, for conveying the paper sheet to the region between the platen and the thermal head independent of the rotating state of the platen, and which is selectively brought to a second operating state, in which the sheet transportation means is released from operative connection with the paper sheet;

head driving means (11, 16) for selectively moving the thermal head between a first position, in which the thermal head is pressed against the platen, and a second position, in which the thermal head is disengaged or spaced from the platen;

selecting means (54, 57, 59) operatively connected to the sheet transportation means and to the head driving means, which is selectively brought to a printable state, in which state the thermal head and the sheet transportation means are in the first position and the second operating state, respectively, and which is selectively brought to a transportation state, in which state the thermal head and the sheet transportation means are in the second position and the first operating state, respectively; and detecting means (40, 56) for detecting passage of the paper sheet and for bringing the selecting means to the printable state.

6. The thermal printer according to claim 5, wherein said platen driving means includes means for stopping rotation of the platen when the selecting means is brought to the transportation state.

7. The thermal printer according to claim 5, wherein said sheet transportation means includes a pair of pinch rollers (10, 62) which are placed in contact with the paper sheet, to transport the sheet in the first operating state, and wherein at least one of said pinch rollers is separated from the paper sheet in the second operating state.

8. The thermal printer according to claim 5, wherein said selecting means is mechanically connected to the platen driving means and to the sheet transportation means, for mechanically moving the same.

9. A thermal printer comprising:

a platen (1);

platen supporting means (2) for rotatably supporting the platen;

platen drive means (3, 5, 7) for rotating the platen;

a thermal head (15) for printing on a paper sheet, the paper sheet being arranged in a region between the platen and the thermal head;

head drive means (11, 16) for selectively moving the thermal head between a first position in which the thermal head is pressed against the platen, and a second position in which the thermal head is disengaged from the platen;

sheet transportation means (9, 10, 62) for selectively feeding a paper sheet in a first direction, such that the paper sheet is fed to the region between the platen and the thermal head, and in a second direction such that the paper sheet is returned from the region between the platen and the thermal head, when the thermal head is in the second position;

detecting means (40) for detecting the passing of the paper sheet moving in the second direction between the platen and the sheet transportation means and for driving the sheet transportation means to transport the paper sheet in the first direction;

wherein said sheet transportation means is selectively brought to a first operating state in which the sheet transportation means is operatively connected with the paper sheet so that the paper sheet is fed, and is selectively brought to a second operating state in which the sheet transportation means is released from the operative connection with the paper sheet; and selecting means (54, 57, 59) operatively connected to the sheet transportation means and to the head drive means, and which is selectively brought to a printable state in which the thermal head and the sheet transportation means are in the first position and the second operating state, respectively, and to a transportation state in which the thermal head and the sheet transportation means are in the second position and the first operating state, respectively;

said head drive means including a first movable member (11) rockably mounted on the platen supporting means and a second movable member (16) rockably mounted on the first movable member and supporting the thermal head, said first movable member being rockable relative to the platen supporting means between an operative position in which the thermal head is situated close to the platen, and a nonoperative position in which the thermal head is remote from the platen, and said second movable member being rockable relative to the first movable member between the first and second positions, when the first movable member is in the operative position;

said sheet transportation means including a first roller (10), a second roller (62) facing the first roller across the paper sheet, a support member (59) for supporting the second roller so that the second roller can touch and leave the first roller, and a drive source (5) for rotating one of the first and second rollers (10, 62), said transportation means being brought to the first operating state when the second roller is in contact with the second roller, and said transportation means being brought to the second operating state when the second roller is separated from the first roller; and said selecting means including a selecting member (54) which is selectively engaged with the support member (59) and with the second movable member (16), so that the second roller is brought close to the first roller by means of the support member when the selecting member engages the support member, and so that the thermal head is brought to the first position by means of the second movable member when the selecting member engages the second movable member.

* * * * *

UNITED STATES PATENT AND TRADEMARK OFFICE

CERTIFICATE OF CORRECTION

PATENT NO. : 4,953,994

DATED : September 4, 1990

INVENTOR(S) : SHIOZAKI ET AL

It is certified that error appears in the above-identified patent and that said Letters Patent is hereby corrected as shown below:

Title page, under Section [30] Foreign Application Priority Data:

Change "62-157117" to --62-157117 [U]--

Change "63-59824" to --63-59824 [U]--

Signed and Sealed this

Thirtieth Day of June, 1992

*Attest:*

DOUGLAS B. COMER

*Attesting Officer*

*Acting Commissioner of Patents and Trademarks*